US006554513B1

(12) United States Patent
Hünniger et al.

(10) Patent No.: US 6,554,513 B1
(45) Date of Patent: Apr. 29, 2003

(54) APPARATUS FOR TRANSPORTING SINGLE SHEETS THROUGH A DEVICE FOR EXPOSING OR PRINTING THE SINGLE SHEETS

(75) Inventors: Heinrich Hünniger, Gumperda (DE); Jörk Hebenstreit, Bad Klosterlausnitz (DE)

(73) Assignee: Agfa-Gevaert AG, Leverkusen (DE)

( * ) Notice: Subject to any disclaimer, the term of this patent is extended or adjusted under 35 U.S.C. 154(b) by 0 days.

(21) Appl. No.: 09/693,620

(22) Filed: Oct. 20, 2000

(30) Foreign Application Priority Data

Dec. 23, 1999 (DE) ..... 199 62 777

(51) Int. Cl.[7] ..... B41J 13/08
(52) U.S. Cl. ..... 400/634; 400/642
(58) Field of Search ..... 400/634, 635, 400/642, 643, 645.3; 271/275, 264, 271, 272

(56) References Cited

U.S. PATENT DOCUMENTS 3,941,375 A * 3/1976 La White et al. ..... 271/251
4,050,816 A * 9/1977 Stemmle ..... 355/75
4,275,969 A 6/1981 Matsuhisa et al. ..... 400/625
4,408,917 A 10/1983 Iwai et al. ..... 400/637.2
5,061,092 A * 10/1991 Takeda et al. ..... 400/240.4
5,062,723 A * 11/1991 Takeda et al. ..... 400/635
5,673,074 A 9/1997 Miyauchi et al. ..... 347/104
5,688,219 A * 11/1997 Renard et al. ..... 493/357
5,775,689 A * 7/1998 Moser et al. ..... 271/198
5,794,922 A * 8/1998 Meglino et al. ..... 256/34
5,855,368 A * 1/1999 Middelberg et al. ..... 271/272
5,968,714 A 10/1999 Leenders et al. ..... 430/346

FOREIGN PATENT DOCUMENTS

DE 196 36 235 3/1998 ..... G03C/1/498

* cited by examiner

*Primary Examiner*—Anthony H. Nguyen
(74) *Attorney, Agent, or Firm*—Darby & Darby

(57) ABSTRACT

An apparatus for transporting single sheets through a device for exposing or printing the single sheets, with a drum and means that press the single sheet against the drum, with a processing station having a processing gap, with the single sheets being exposed or printed in the processing station, includes means that limit the processing gap. According to the invention, the means for limiting the processing gap are moveable so said the distance between the drum and the means for limiting the processing gap can be increased or decreased.

6 Claims, 2 Drawing Sheets

APPARATUS FOR TRANSPORTING SINGLE SHEETS THROUGH A DEVICE FOR EXPOSING OR PRINTING THE SINGLE SHEETS

BACKGROUND OF THE INVENTION

1. Field of the Invention

The present invention is directed to an apparatus for transporting single sheets through a device for exposing or printing single sheets. The apparatus includes a print drum and is constructed in such a way that a single sheet is pressed against the print drum. A processing station is associated with the print drum which is formed to include a processing gap. The processing gap includes a mechanism for limiting the processing gap so that the distance between such mechanism and the print drum surface can be increased or decreased.

2. Description of the Related Art

U.S. Pat. No. 5,968,714 discloses an apparatus for recording information on photographic material that can be thermally developed. The apparatus includes a heated drum which deflects each single sheets by approximately 180°. In a first segment of the deflection, the single sheet is urged against the drum by four pressure rollers. An exposure gap is located between these pressure rollers, with a laser recording on the single sheet through this gap. After the exposure step, the pressing operation is taken over by a continuous belt which wraps around the drum in this stage of the deflection. The continuous belt is provided to maintain the single sheets in close contact with the drum so as to ensure an optimal heat transfer between the drum and the single sheet.

SUMMARY OF THE INVENTION

It is the object of the invention to form means for guiding single sheets on a drum past a processing gap so that both the leading edge and the trailing edge of the single sheets can be transported past the processing gap unhindered and without hitting anything, thereby ensuring a continuous, jerk-free motion of the single sheets across the processing gap.

The object is solved by an apparatus having means for limiting the processing gap which are moveable in such a way that the distance between the drum surface and the means for limiting the processing gap is increased or decreased. The internal stress of the individual sheets lifts both the leading edge and the trailing edge from the drum during transport across the exposure gap as soon as the respective edge has passed the means for limiting the processing gap. This sudden lifting causes synchronizing errors in the processing station. For example, when photographic paper is exposed in the processing gap with a laser beam, this sudden lifting causes noticeable image defects. The movability of the means for limiting the processing gap can prevent a sudden lifting of the single sheets from the drum and can therefore significantly improve the image quality in a laser exposure station.

Advantageously, the diameter of the drum can be selected to be no less than 150 mm. For smaller diameters, for example, when using photographic paper, the force produced by the internal stress of the photographic paper can be so large as to urge the leading edge and the trailing edge in the exposure gap away from the drum surface. Likewise, even if the exposure gap were very narrow, the lack of guiding in the exposure gap can change the spacing between the drum surface and the leading and trailing paper edge, so that the image quality may no longer be acceptable.

Advantageously, a plurality of parallel flat belts maintains contact between the single sheets and the drum surface both in front of and behind the processing gap. The means for limiting the processing gap have the form of a comb and are located in front of and behind the processing gap, with the individual teeth of the comb projecting in the space between the belts.

An optimal result can be attained if the means for limiting the processing gap in front of and behind the processing gap are moveable.

In the open, raised position, both combs advantageously form a tapered gap with the drum surface. The wider portion of the gap has a dimension so that the distance between the comb and the drum surface is always greater than the distance between the drum surface and the leading or trailing edge of the single sheet lifted from the drum surface by the internal stress.

To keep the region of the processing gap where the leading edge and the trailing edge of the single sheets are not guided, as small as possible, the comb positioned behind the processing gap can preferably be moved into the raised position, in front of the leading edge of a single sheet leaves the processing gap, but not in front of the trailing edge of a previously processed single sheet has passed the comb.

As soon as the leading edge of single sheet is transported past the comb positioned behind the processing gap and thereby inserted between the drum surface and the flat belts, this comb can be moved into the lower position.

In front of the trailing edge of the single sheet reaches the comb positioned in front of the processing gap, this comb can be moved into the raised, open position. In this way, the trailing edge of the single sheet is not suddenly lifted from the drum surface, but proceeds slowly and continuously to contact the comb in the raised position.

Advantageously, only one comb is in the open position and lifted off the drum surface at any given time. With this arrangement, the region where the single sheet is not guided, can be kept very small.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
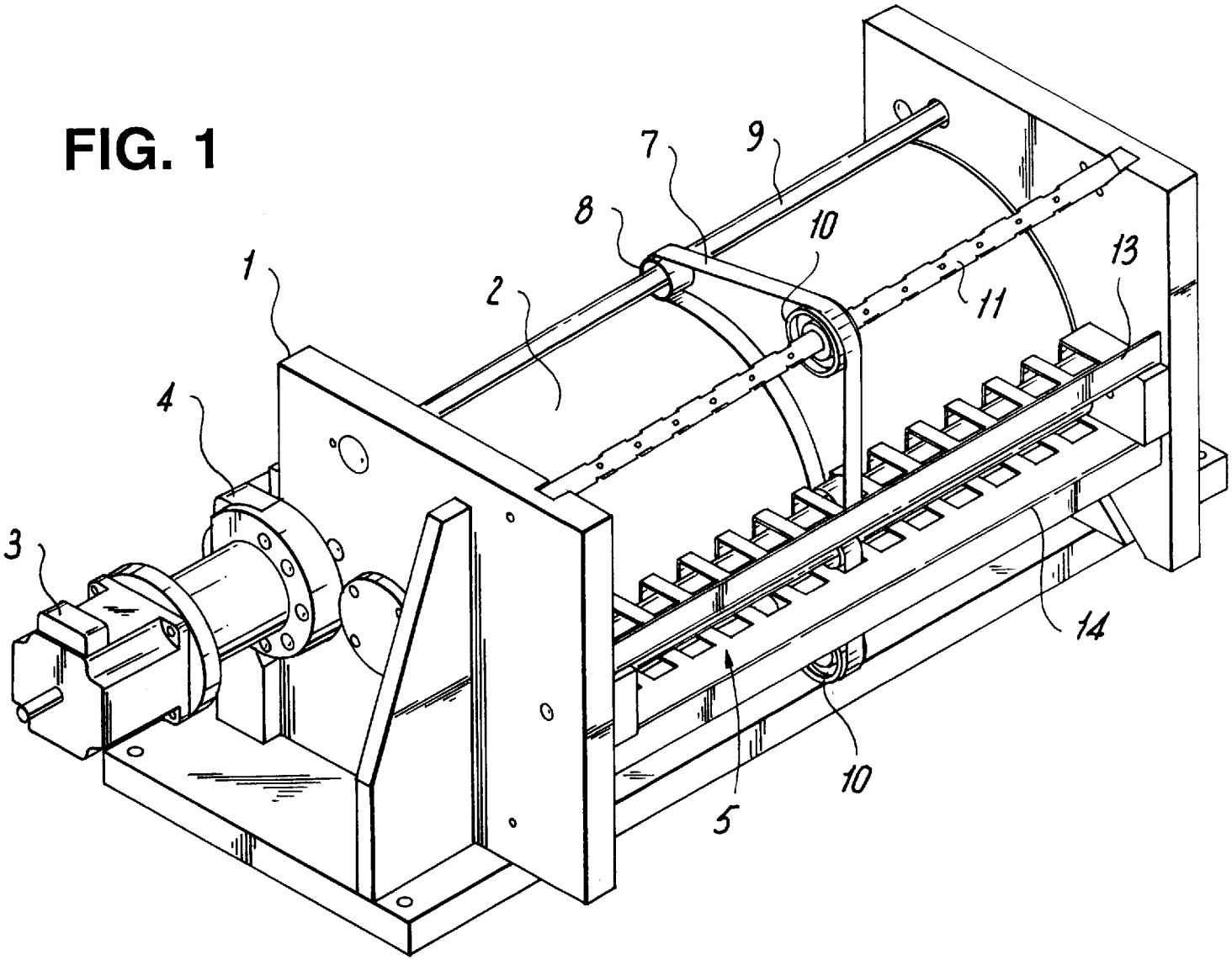
FIG. 1 is a perspective schematic representation of a laser exposure unit for photographic paper according to the invention, FIG. 2 a cross-section through the apparatus of FIG. 1, and FIG. 3 an enlarged detail of FIG. 2.
Figure 3:
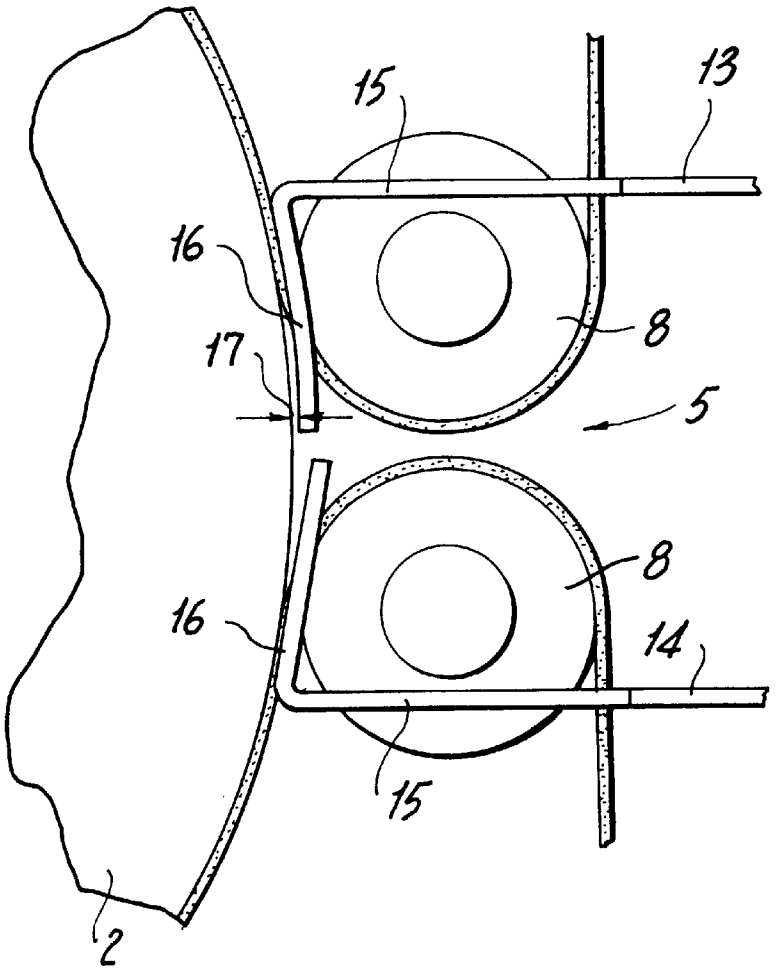

Referring now to the laser exposure device illustrated in FIG. 1, a print drum 2 is supported in a frame 1. The print drum is driven by a motor 3. A friction gear 4 is installed between the motor and the print drum, wherein the friction gear 4 converts the fast rotation of the motor axis into a slower, but exceptionally uniform rotation of the print drum.

Respective belt units 6 that keep the single sheets in contact with the print drum are provided on either side of the exposure gap 5. For sake of clarity, only one of the belt units 7 is shown. The respective belts are tensioned by two stationary deflection rollers 8. Parallel deflection rollers are each supported on a carrier 9.

The deflection rollers of the belt unit that are positioned in front of the exposure gap in the transport direction of the single sheets and form the front-feed device for the single sheets to the print drum, have a somewhat greater spacing from the drum surface than the other deflection rollers and thereby form with the print drum a tapered front-feed gap 18. The gap 18 can reliably receive also thicker single sheets, even if the front edge deviates slightly from its nominal position.

Tension rollers 10 apply a predefined tension to each belt, so that each belt always presses with the same force against the drum surface, regardless if a thick or thin paper or no paper at all is positioned on the print drum.

Figure 2:
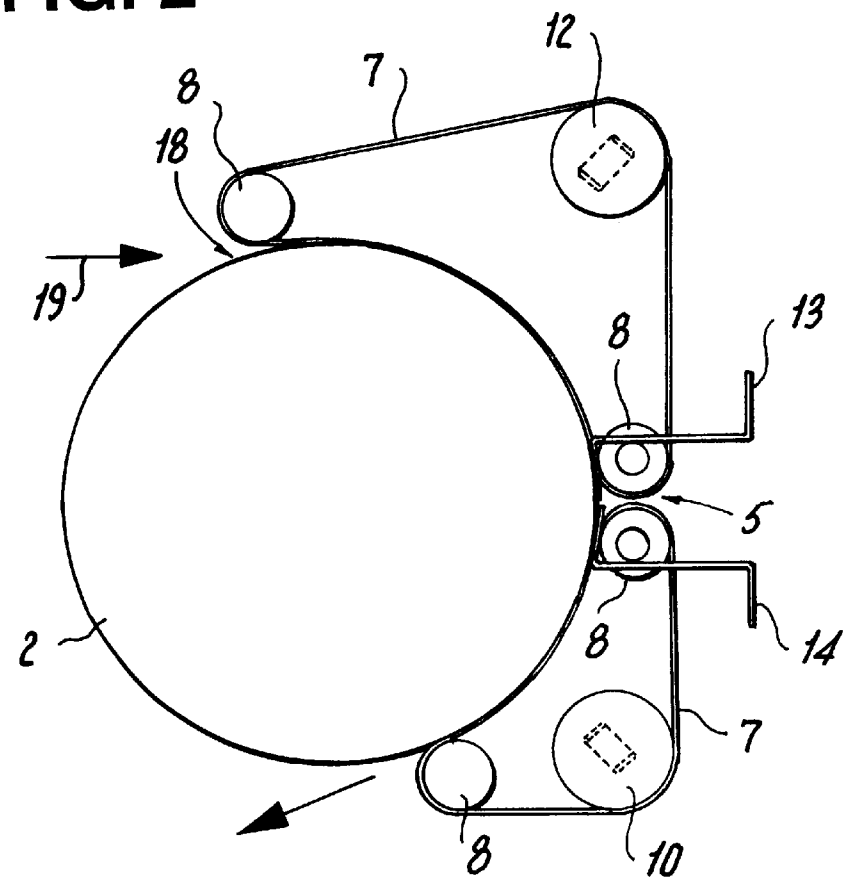

Parallel tension rollers are also supported on a common support 11, with a respective spring 12 urging each bearing against the support in the tensioning direction (see FIG. 2).

The individual belt assemblies do not have a drive and are moved exclusively by the print drum.

The exposure gap 5 is bounded by two comb-like guide plates 13, 14, with the teeth 15 of the guide plates 13, 14 extending through the belt assemblies. Each tooth has a lower leg 16 extending approximately parallel to the surface of the print drum. The gap 17 between the print drum and each of the tooth legs corresponds approximately to the thickness of the thickest photographic paper to be processed.

Both guide plates are moveable, so that the free ends of the tooth legs 16 can be lifted from the drum surface, thereby producing a tapered gap between the legs and the print drum. When a single sheet is supplied to the front-feed gap 18 in the direction of the arrow 19, a gap is formed between the flat belts of the front belt unit and the print drum across the width of the single sheet. The adjacent belts continue to contact the drum surface directly. By decoupling the individual belt assemblies, transverse or twisting forces acting on the single sheet are eliminated, so that the sheet is transported totally straight and uniformly.

Before the leading edge of the single sheet reaches the deflection rollers of the first belt unit which are located directly in front of the exposure gap 5, the guide plate 13 which is also located in front of the exposure gap, is moved, so that the lower leg 16 extends approximately parallel to the drum surface. The guide plate 14 located behind the exposure gap, on the other hand, is brought into a position where it's lower leg forms a tapered gap with the drum surface.

The first guide plate 13 thereby maintains the close contact between the leading edge of the single sheet and the print drum. The leading edge is lifted slightly from the drum surface only after passing the actual exposure gap 5. The leading edge is immediately and gently captured by the second guide plate 14 and again pressed against the print drum in the tapered gap. The extremely accurate angle of the tapered gap provides an essentially jerk-free transport of the leading edge across the exposure gap.

Before the trailing edge of the single sheet reaches the first guide plate 13, the guide plate 13 is lifted into a position where it forms a tapered gap with the print drum. When the trailing edge reaches this guide plate, the trailing edge can lift off slightly from the print drum without jerking, conforming to the stress inherent in the paper. Because the second guide plate 14 positioned behind the exposure gap is in the lower position, the trailing edge of the single sheet makes again approximate contact with the print drum behind having passed the exposure gap.

With the arrangement according to the invention, single sheets can be exposed borderless from their leading edge to their trailing edge with excellent image quality.

It'll be understood that the invention is not limited to laser exposure devices for photographic paper. The invention can advantageously also be used in other devices where single sheets are printed borderless in a narrow processing gap. An exemplary apparatus is an inkjet printer for printing single sheets.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. Apparatus for transporting single sheets to a device for printing on said sheets, comprising:

a print drum, first means for pressing a sheet against the drum, second means for pressing a sheet against the drum, the first and second pressing means being spaced apart to form a processing gap extending across substantially the entire width of the sheet whereby printing of the sheet is enabled from edge to edge across the processing gap, and first and second guide means associated with said first and second pressing means, respectively, each said guide means extending across substantially the entire width of the sheet, said first guide means being mounted to be movable to first and second positions with respect to the surface of the drum, in the first position the guide means maintain the leading edge of a sheet in contact with the drum as said leading edge moves past the processing gap, and in the second position the guide means permit the trailing edge of the sheet to lift off of the drum as it approaches the processing gap.

2. Apparatus according to claim 1, wherein said second guide means is movable with respect to the surface of the drum to receive the leading edge of a sheet after it moves past the processing gap and thereafter press the sheet against the drum.

3. Apparatus according to claim 2, wherein said first and second guide means are each movable to form a tapered gap with respect to the surface of the drum.

4. Apparatus according to claim 2, wherein said first and second guide means are positioned in front of and behind the processing gap, respectively.

5. Apparatus according to claim 4, wherein said first and second guide means alternate in their operation whereby the leading edge of a sheet is first pressed against the drum before the processing gap and the trailing edge is allowed to move away from the drum as it moves past the processing gap.

6. Apparatus according to claim 1, wherein said first and second means for pressing comprises a plurality of spaced apart belts and portions of said first and second guide means are in the gaps between adjacent belts.

* * * * *